US006705196B2

(12) United States Patent
Mueller et al.

(10) Patent No.: US 6,705,196 B2
(45) Date of Patent: Mar. 16, 2004

(54) AMMUNITION DRUM AND FIREARM

(75) Inventors: Kurt Mueller, Zürich (CH); René Alfred Hagmann, Opfikon (CH)

(73) Assignee: Oerlikon Contraves AG, Zurich (CH)

( * ) Notice: Subject to any disclaimer, the term of this patent is extended or adjusted under 35 U.S.C. 154(b) by 0 days.

(21) Appl. No.: 10/281,522

(22) Filed: Oct. 28, 2002

(65) Prior Publication Data

US 2003/0136252 A1 Jul. 24, 2003

(30) Foreign Application Priority Data

Nov. 15, 2001 (CH) ..... 2001 2096/01

(51) Int. Cl.[7] ..... F41A 9/26

(52) U.S. Cl. ..... 89/33.02; 89/1.816

(58) Field of Search ..... 89/33.01, 33.02, 89/33.03, 33.04, 33.17, 1.802, 1.804, 1.803, 1.816, 34, 13.05

(56) References Cited

U.S. PATENT DOCUMENTS

| | | | | |
|---|---|---|---|---|
| 1,787,354 A | | 12/1930 | Bochnak | |
| 2,356,304 A | | 8/1944 | Da Costa | |
| 2,380,024 A | * | 7/1945 | Chandler | 89/13.05 |
| 2,801,575 A | * | 8/1957 | Grover | 89/155 |
| 3,134,301 A | * | 5/1964 | Even | 89/33.02 |
| 3,504,593 A | * | 4/1970 | Ricks et al. | 89/1.807 |
| 4,128,039 A | * | 12/1978 | Skliris | 89/1.803 |
| 4,198,897 A | | 4/1980 | Lipp et al. | |
| 4,426,802 A | | 1/1984 | Walker | |
| 4,535,676 A | | 8/1985 | Politzer et al. | |
| 4,635,527 A | * | 1/1987 | Carrier et al. | 89/1.816 |
| 4,719,839 A | | 1/1988 | Smothers et al. | |
| 4,766,800 A | * | 8/1988 | Miller et al. | 89/33.02 |
| 4,934,244 A | | 6/1990 | Johnson, Jr. | |
| 5,668,343 A | | 9/1997 | Simon | |

FOREIGN PATENT DOCUMENTS

| | | |
|---|---|---|
| EP | 0 136 832 A | 4/1985 |

* cited by examiner

*Primary Examiner*—Michael J. Carone
*Assistant Examiner*—Gabriel S Sukman
(74) *Attorney, Agent, or Firm*—McCormick, Paulding & Huber LLP

(57) ABSTRACT

An ammunition drum (110) and firearm with an ammunition drum (110). The ammunition drum designed for being mounted on a firearm has at least two projectile channels (118), which are arranged around a longitudinal drum axis (112). The ammunition drum (110) has at least two drum segments (114.1, 144.2, 114.3), which are connected with each other.

9 Claims, 4 Drawing Sheets

AMMUNITION DRUM AND FIREARM

CROSS REFERENCE TO RELATED APPLICATION

Applicant hereby claims foreign priority under 35 U.S.C. §119 from Swiss Application No. 2001 2096/01 filed Nov. 15, 2001, the disclosure of which is herein incorporated by reference.

The invention relates to an ammunition drum for a firearm, having at least two projectile channels arranged around a longitudinal drum axis. The invention further relates to a firearm, having at least one barrel and at least one ammunition drum.

BACKGROUND OF THE INVENTION

Ammunition drums of this type are used for feeding projectiles to the barrel of a firearm. They have several projectile channels, which are arranged at even mutual angular distances around the longitudinal axis of the drum. Generally, but not absolutely, the longitudinal drum axis, the longitudinal channel axes and the core axis of the barrel are aligned in parallel. The ammunition drum can be rotated in steps around the longitudinal drum axis; in the course of its rotation it makes stops for a limited pause at defined angular positions between successive steps. In this way the projectile channels come into different positions in turns, in particular into a receiving position, in which they take up a projectile, and into a feed position, in which they deliver the projectile. In this case the projectile channel is located at the inlet side in front of the barrel, i.e. the projectile channel and the barrel are arranged coaxially in respect to each other. Depending on the firearm with which they are used, the ammunition drums can comprise different numbers of projectile channels, and the number of the steps and pauses are different. In theory, the feeding of ammunition to a barrel is possible by means of an ammunition drum with only a single projectile channel which, in the course of a full rotation of the ammunition drum, is only brought into two positions. However, generally ammunition drums have several, often three to six, projectile channels. The number of the projectile channels corresponds to the number of positions of the ammunition drum in which their step-by-step rotation is interrupted by a pause.

Ammunition drums of the customary type are very well suited for feeding comparatively small-caliber ammunition to comparatively light guns. However, in connection with the use of ammunition drums for heavier guns numerous problems arise in feeding ammunition, both during the employment of the firearm, as well as in the manufacture and mounting of the ammunition drum.

When used in firearms, it is necessary to accelerate and decelerate the mass during each step in the course of the rotation of the ammunition drum. This mass is composed of the mass of the projectiles to be conveyed and of the mass of the ammunition drum itself. Both the mass of the projectiles and the mass of the drum increase with increasing caliber of the projectiles. Although the mass to be moved can be kept relatively low, even with comparatively large calibers, if ammunition drums with few projectiles are used, it is difficult in this case to achieve the high rate of fire considered necessary for modern guns.

When employing the weapons, essentially two disadvantages arise because of large masses to be moved. For one, the position of the gun and therefore the direction of the barrel can be changed on account of reactive forces exerted on the gun during each acceleration and deceleration of the ammunition drum; this has the result that the dispersion pattern changes, or the weapons effect is reduced. Furthermore, the large forces cause great wear on the moved parts, which has a negative effect on the firearm and results in a reduction of its service life.

But the manufacture of ammunition drums having a large mass also has disadvantages. For one, the weight of the ammunition drum becomes so great that it can no longer be moved and mounted without aids. Furthermore, it is necessary to use materials which are highly wear-resistant, since this material must be selected with an eye to the greatest possibly arising wear, although this wear occurs on only a few locations. Highly wear-resistant materials are in general specifically heavy and in any event comparatively expensive, not only in obtaining them, but in most cases also in processing them, since they are not easily workable; in this connection it is particularly disadvantageous that errors in processing occurring during the end phase of manufacturing cause the entire ammunition drum to become waste, so that it is necessary to accept a comparatively large loss of material and processing time.

To reduce the mentioned disadvantages, an attempt was made to reduce the mass of the ammunition drums by suitable shaping, in that cutouts were made in the areas which are not, or only slightly stressed. However, in this case the same amount of initial material is required, and processing is not simpler, but more elaborate. Moreover, there are limits to the application of cutouts, since the shape, and in particular the wall thickness of the remaining mass, must be such that it is still possible to work in cooling conduits for a coolant. It is alternatively possible to provide an exclusive cooling by means of the ambient air, but for this a shape with cooling ribs is required, which again makes processing more elaborate.

In summary it can be stated that no ammunition drums are known which would be suitable for feeding large-caliber projectiles to barrels.

OBJECT AND SUMMARY OF THE INVENTION

It is the object of the invention to

- produce an ammunition drum of the type mentioned at the outset, by means of which the disadvantages of the prior art are avoided in its use, as well as in its manufacture, and
- to propose a firearm with an ammunition drum also suitable for large-caliber projectiles.

The novel ammunition drum is built in a modular fashion and therefore differs from conventional ammunition drums in that it is produced from at least two, but generally three or more drum segments. The mass of the individual drum elements is reduced by this, so that their handling is made easier. A processing error in an end phase has no grave consequences, since only the affected drum segment needs to be replaced, and not the entire ammunition drum. In case of an inspection of the firearm it is moreover possible to only replace damaged drum segments, so that the total service life of the ammunition drum is increased.

To make the precise fitting of adjoining drum segments easier, it is advantageous to provide the touching separating faces of these drum segments with complementary fitting elements.

The ammunition drum can be designed in such a way that the drum segments are longitudinal segments, wherein the separation between adjoining drum segments essentially extends in the direction of the longitudinal drum axis. With a configuration of this type it is possible to embody the drum segments sector-like and preferably uniform. In general, each drum segment contains a projectile channel, but it is also possible to arrange several projectile channels in each longitudinal segment, or to arrange a spacing element without a projectile channel between two longitudinal segments with projectile channels. One projectile channel can also be bordered partially by one and partially by a second, adjoining longitudinal element. The projectile channels can have an insert in the form of a highly heat-resistant and low-abrasion insert; this allows the manufacture of the portions of the longitudinal segment surrounding the insert from a material which can be stressed less and is comparatively cost-effective.

An ammunition drum, whose drum segments are transverse segments, has proven itself to be particularly advantageous, wherein the separation between adjoining transverse segments essentially extends transversely in respect to the longitudinal drum axis.

In this case the ammunition drum is generally designed in such a way that it has a center segment consisting mainly of projectile channels. The center segment can be a single element and comprise the totality of the projectile channels, or it can consist of several, preferably uniform segment units. In general, every segment unit comprises one, or possibly even more than one projectile channel. But the ammunition drum can also be embodied in such a way that the center segment has segment units with and without a projectile channel in alternation.

Center segments with a plurality of segment units are particularly advantageous from the viewpoint of cooling. The segment units can be embodied to be tube-like, so that special coolant channels can possibly be omitted.

Furthermore, an ammunition drum made of transverse segments has a transverse segment embodied either as a front segment or as a rear segment; viewed in the firing direction of the firearm, the front segment is located at the front, and the rear segment at the rear of the center segment. The ammunition drum preferably is comprised of a front segment as well as of a rear segment.

With very large ammunition drums it is possible not only for the center segment to be transversely divided, but also the front and/or the rear segment. Very long transverse segments can be again divided into several transverse segments.

The course of the diameters of the projectile channels over the length of the ammunition drum is a function of the shape of the cartridge to be fired. For cylindrical cartridges, the projectile channels can have a constant diameter over the axial length of the ammunition drum and can possibly be used for returning the empty cartridges after firing. For non-cylindrical cartridges the projectile channels can have a rear area of larger diameter as a shell seating, or cartridge seating, and a front area of lesser diameter; with such an arrangement the empty shells are ejected toward the rear.

The projectile channels are the parts of the ammunition drum which are the most thermally and mechanically stressed; in a construction with a center segment, a front segment and/or a rear segment, it is possible to select a high-quality, in particular greatly heat-resistant material, for the center segment, while the front segment and the rear segment can be produced from less resistant, but more cost-effective, lighter and easier to work materials.

In connection with this it has been shown to be advantageous to embody the ammunition drum in such a way that the projectile channels run over the entire drum length and therefore extend from the center segment in, or through, the front segment, and in, or through, the rear segment.

To increase the useful life of the ammunition drum and to assure dependable functioning it is necessary to keep the temperature of the ammunition drum, and of the projectile channels in particular, within a limited temperature range, and to this end to cool them sufficiently. This is particularly important in connection with weapons with a high rate of fire and with comparatively light drums, such as are preferred for dynamic reasons. Measures for cooling must assure that cooling is not only performed at the moment of firing, but also thereafter; it is intended by this to prevent the spontaneous ignition, in particular the spontaneous ignition of the projectiles remaining after the last shot in the projectile channel, which is also known as the cook-off effect. Monitoring of the cooling effect can be performed in a simple manner if cooling takes place with the aid of a coolant circulating through coolant channels. In this case it is sufficient to provide a flow-through monitor which, with insufficient coolant flow, generates a warning signal. Cooling devices of this type are suitable for all ambient temperatures, in particular also for very high ambient temperatures.

The following should be observed when selecting a suitable coolant: the coolant must not evaporate a high temperatures or chemically change in disadvantageous ways; the coolant must not freeze at low temperatures or have too great a viscosity; in no way must the coolant be corrosive or abrasive. A suitable coolant is water, for example, which has been provided with a suitable additive. Glycol can be used as additive, for example, which provides protection against cold and corrosion.

In place of cooling by means of a particular coolant, for example water with an additive, cooling can also take place with the aid of the ambient air, provided the ammunition drum has a suitable shape. Suitable shaping, for example by cooling ribs, can be provided here in place of coolant channels.

Generally those areas of ammunition drums which are divided into transverse segments and have a front segment, a center segment and a rear segment extending into the interior of the front segments, or of the rear segment, must be cooled. This is all the more important, the greater the axial length of the areas of the projectile channels arranged in the interior of the front segment, or the rear segment, is. Coolant channels can be provided for this purpose in the front segments and/or the rear segments. To produce the cooling channels as simply as possible, it is advantageous to cut one or several cutouts into the exterior surface of the segment units of the center segment, namely in that area which comes to lie in the front segment or the rear segment; together with the wall of the front segment, or the rear segment which, in the mounted state is oppositely located, the wall of this cutout then delimits a cooling channel which is optimal, i.e. closest, to the location of the heat generation. Outside of the front segment, or the rear segment, cooling can then take place without special coolants, merely with the aid of the ambient air. A sufficient cooling effect is obtained with such a construction, along with a simple shaping and low coolant consumption.

The individual drum segments can be connected in various ways with each other. The connection can take place, for example, without connecting elements, merely by an interlocking or frictional connection.

The movement of the ammunition drums takes place from the outside, for example, by means of drive rollers. The feeding of cartridges can take place by means of a central drive member arranged in a central opening or cutout of the ammunition drum.

A connection by means of integral connecting elements can be mentioned as an example for an interlocking connection of drum segments, for example a connection by means of complementary grooves and projections; by means of this it is possible in particular to fasten drum segments, which are embodied as longitudinal segments, to each other, whose separating planes extend in the direction of the longitudinal drum axis, preferably diametrically.

A contracting connection can be mentioned as an example for a frictional connection of drum segments, by means of which a center segment, or segment units of a center segment, in particular can be fastened on a front segment or a rear segment.

However, the ammunition drum can also have additional connecting elements, for example screws, by means of which the drum segments are braced against each other; in this connection it can be essential to provide screw-locking devices in order to prevent the loosening of the screws because of the dynamic loads under use; in this way it is possible in particular to brace center segments, or units of center segments, between the front segment and the rear segment. In place of the mentioned connections of drum segments, it is also possible to provide other suitable connections. For example, the center segment can be connected by welding with the front segment and the rear segment; however, this may make a later processing, in particular of the projectile channels, necessary.

The novel ammunition drum is designed to be fastened on a firearm. For retrofitting existing firearms it is preferably designed in such a way that no changes are required for mounting and for the movement of the ammunition drum on the firearm.

Further advantages and details of the invention will be explained in what follows by means of exemplary embodiments and by reference to the drawings.

DETAILED DESCRIPTION OF THE PREFERRED EMBODIMENTS

It should be noted at the outset that the drawings are not to scale.

Figure 1:
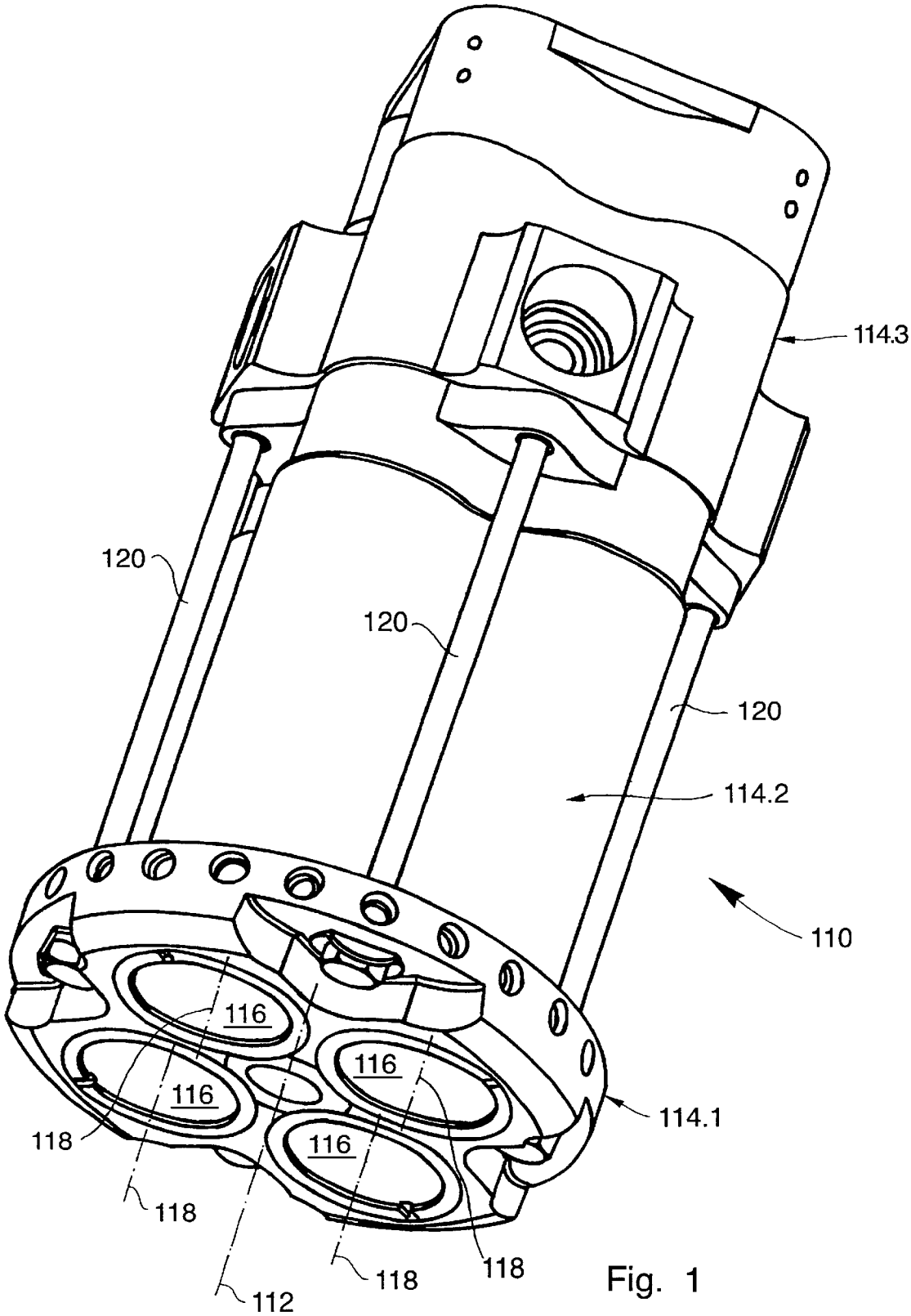
FIG. 1 is a diagram of an exemplary embodiment of an ammunition drum in accordance with the invention.

FIG. 1 shows an ammunition drum 110 with a longitudinal drum axis 112. Transversely in respect to the longitudinal drum axis 112, the ammunition drum 110 is divided into three drum segments 114.1, 114.2, 114.3 embodied as transverse segments, and furthermore has three connecting elements 120 in the form of screws. The first drum segment 114.1, also called rear segment 114.1, is represented in FIG. 2; the second drum segment 114.2, also called center segment 114.2, essentially consists of four identical segment units extending parallel in respect to the longitudinal drum axis 112 and is represented in FIG. 3; the third drum segment 114.3, also called front element 114.3, is represented in FIG. 4.

In general, the transverse segments touch at their separating faces, which extend transversely in respect to the longitudinal drum axis 112. The separating faces of a transverse segment need not be continuous, i.e. several individual partial separating faces can be present on a transverse segment, which are separated from each other by cutouts. The separating faces can also have partial separating faces extending in the direction of the longitudinal drum axis, in particular for providing fitting elements, which make the precise joining of the transverse elements easier. Moreover, the separating faces can also be formed so they run together in the direction of the longitudinal drum axis, or have partial separating faces which run together, which also makes the precise assembly of the individual transverse segments easier.

Figure 2:
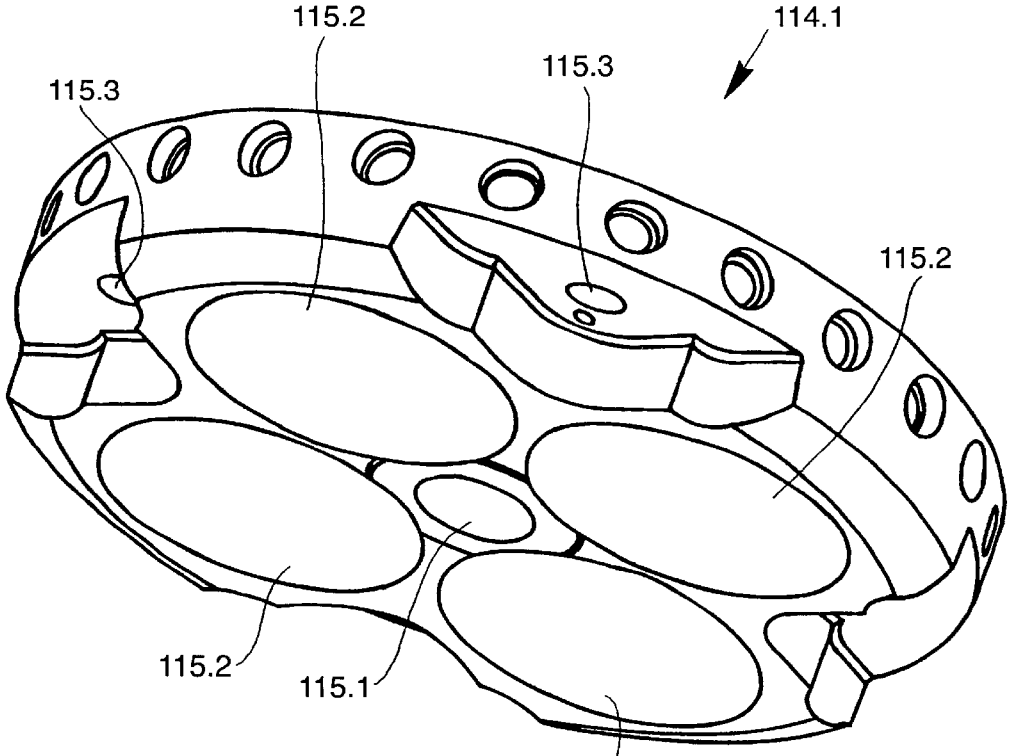
FIG. 2 is a diagram of a front portion of the ammunition drum represented in FIG. 1.

In accordance with FIG. 2, the rear segment 114.1 is designed similar to a flange and has a centered bore 115.1 for receiving a shaft, not represented, by means of which the ammunition drum 110 can be put into rotation when it is fastened on a firearm, not represented. The rear segment 114.1 has four bores 115.2, which are arranged at even mutual angular spacings of 90° and at equal distances from the centered bore 115.1. The bores 115.2 are used for receiving the rear ends of the segment units 114.4 of the center segment 114.2. Moreover, the rear segment 114.1 has four bores 115.3 for receiving the connecting elements 120.

Figure 3:
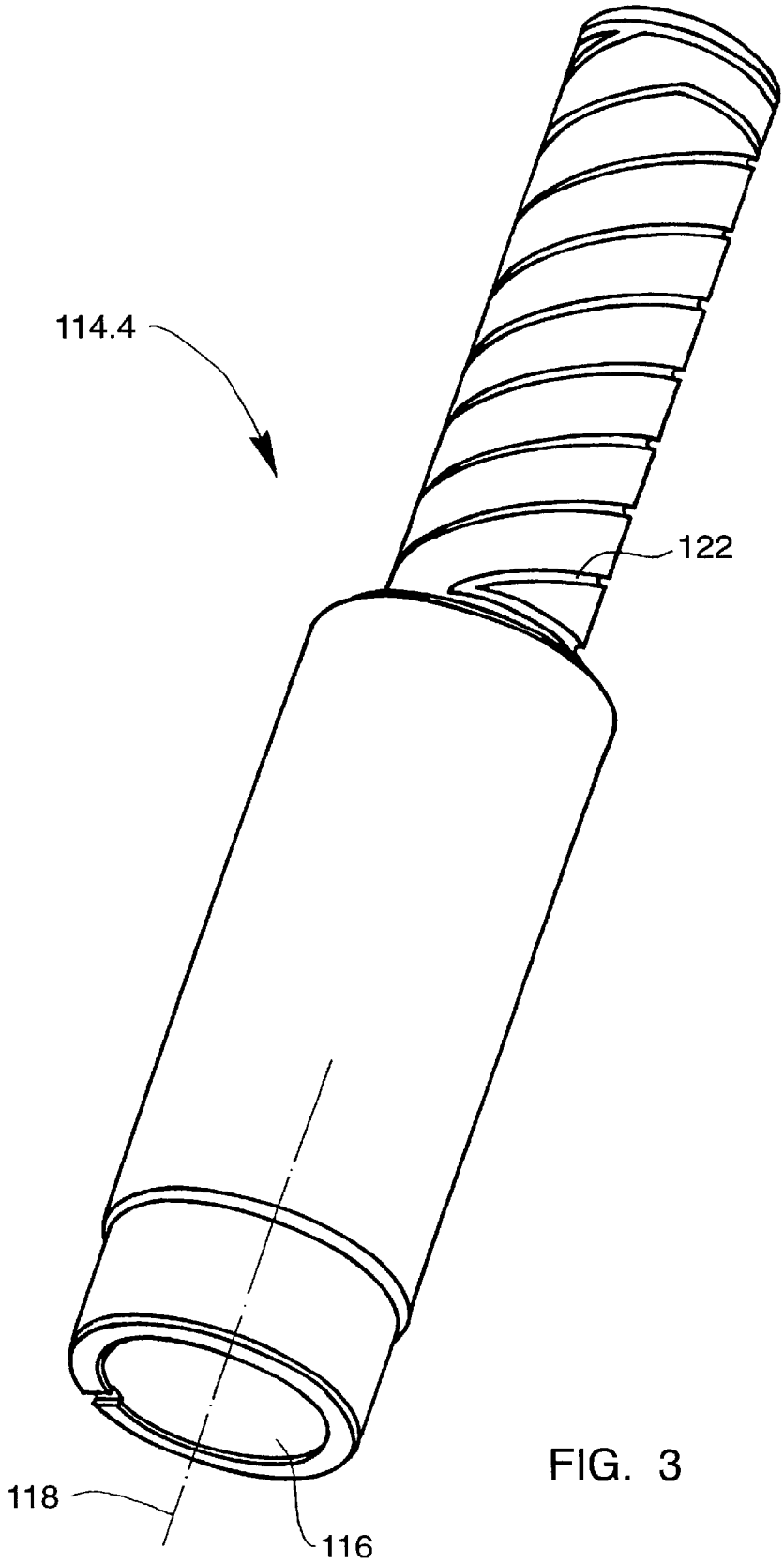
FIG. 3 is a diagram of a longitudinal segment of a center section of the ammunition drum represented in FIG. 1.
Figure 4:
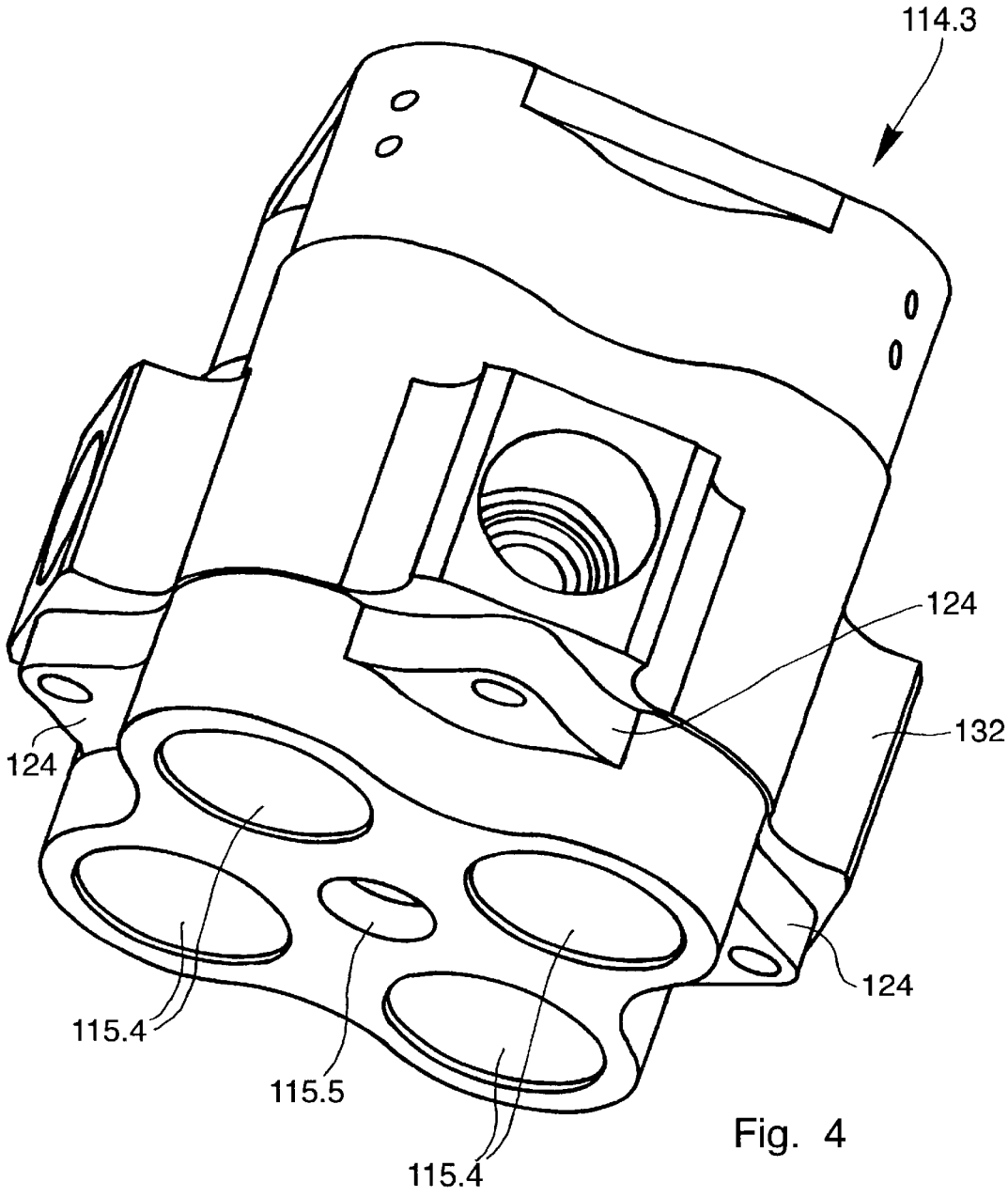
FIG. 4 is a diagram of a rear section of the ammunition drum represented in FIG. 1.

In accordance with FIG. 3, each one of the segment units 114.4 of the center segment 114.2 is designed in a tube shape and delimits a projectile channel 116, having a longitudinal channel axis 118. The segment units 114.4 can also be delimited otherwise than cylindrical, and the center segment 114.2 can also be embodied as a single part. The longitudinal channel axes 118 are oriented parallel with the longitudinal drum axis 112. In accordance with FIG. 1, each segment unit 114.4 of the center segment 114.2 extends over the entire axial length of the ammunition drum 110, i.e. the rear end of each segment unit 114.4 projects into the rear segment 114.1, and the front end into the front segment 114.3. The exterior diameter of the front portion of each segment unit 114.4 is less than the exterior diameter of its rear portion. A cutout 122, preferably helical, which constitutes a first border of a coolant channel, extends over the external surface of the front portion of each segment unit 114.4. A second border of the coolant channel is formed by the interior wall of a bore 115.4 of the front segment 114.3. It is also possible for several coolant channels to be present in a front segment. The coolant channels are intended to receive a coolant, which circulates when the weapon is used. A strip at the front end of the front portion is of such a size that sealing problems of the circulating coolant are prevented.

The front segment 114.3 represented in FIG. 4 has a central bore 115.5. In the assembled state of the ammunition drum 110, the bore 115.5 is aligned with the central bore 115.1 of the rear segment 114.1 and is used for receiving the shaft, not represented, used for seating the ammunition drum 110 and for driving the ammunition feeding device. Furthermore, the front segment 114.3 has the already mentioned four bores 115.4 which, in the assembled state of the ammunition drum 110, receive the front ends of the center segment 114.2, or of the segment units 114.4 of the center segment 114.2. The front segment 114.3 moreover has four flange-like protrusions 124 with bores 125, in which the connecting elements 120 are received in the mounted state of the ammunition drum 110. Furthermore, four connection places 132 are formed on the front segment 114.3 and are used for receiving drive rollers, by means of which the driving of the ammunition drum 110 takes place.

What is claimed is:

1. An ammunition drum for a firearm, comprising:

at least two projectile channels arranged around a longitudinal drum axis, and at least two drum segments, which are connected to each other, the drum segments being embodied as transverse drum segments, wherein the transverse drum segments have at least one bordering face, which extends essentially transversely in respect to the longitudinal drum axis, one of the transverse drum segments being embodied as a front drum segment, one of the transverse drum segments being embodied as a rear drum segment, one of the transverse drum segments being embodied as a center drum segment, the center drum segment having drum segment units extending in the direction of the longitudinal drum axis, and having a projectile channel extending through each drum segment unit and into one of the adjacent drum segments, said adjacent drum segment comprising at least one coolant channel through which coolant is intended to flow, said coolant channel being delimited on one side by the wall of a cutout in the exterior surface of one of the drum segment units, and on the other side by the oppositely located wall of a bore of said adjacent drum segment.

2. The ammunition drum in accordance with claim 1, wherein adjoining drum segments have complementary fitting elements.

3. The ammunition drum in accordance with claim 1, wherein the drum segments are at least partially fastened to each other in an interlocking manner.

4. The ammunition drum in accordance with claim 1, wherein the drum segments are at least partially fastened to each other in a frictionally connected manner.

5. The ammunition drum in accordance with claim 1, further including connecting elements by means of which the drum segments are fastened to each other.

6. The ammunition drum in accordance with claim 1, further including an arrangement for cooling.

7. The ammunition drum in accordance with claim 6, wherein the arrangement for cooling has cooling areas on at least one of the drum segments, which are intended to give off heat to a coolant.

8. The ammunition drum in accordance with claim 1, wherein the transverse drum segments are made of different materials, wherein the transverse drum segment forming the projectile channels is made of a material which is of a strength and great heat resistance, which is increased in comparison with the remaining transverse drum segments.

9. A firearm with an ammunition drum, the ammunition drum comprising:

at least two projectile channels arranged around a longitudinal drum axis, and at least two drum segments, which are connected to each other, the drum segments being embodied as transverse segments, wherein the transverse drum segments have at least one bordering face, which extends essentially transversely in respect to the longitudinal drum axis, one of the transverse drum segments being embodied as a front drum segment, one of the transverse drum segments being embodied as a rear drum segment, one of the transverse drum segments being embodied as a center drum segment, the center drum segment having several drum segment units extending in the direction of the longitudinal drum axis, and having a projectile channel extending through each drum segment unit and into one of the adjacent drum segments, said adjacent drum segment comprising at least one coolant channel through which coolant is intended to flow, said coolant channel being delimited on one side by the wall of a cutout in the exterior surface of one of the drum segment units, and on the other side by the oppositely located wall of a bore of said adjacent drum segment.

* * * * *